US005611385A

United States Patent [19]

Hsu

[11] Patent Number: 5,611,385

[45] Date of Patent: Mar. 18, 1997

[54] DISTANCE ADJUSTING STRUCTURE FOR A VERTICAL BLIND

[75] Inventor: Peyson Hsu, Changhua Hsien, Taiwan

[73] Assignee: Ching Feng Blinds Ind., Co., Ltd., Changhua Hsien, Taiwan

[21] Appl. No.: 593,052

[22] Filed: Jan. 29, 1996

[51] Int. Cl.[6] ..... E06B 9/30

[52] U.S. Cl. ..... 160/173; 160/168.1; 160/178.1; 160/900

[58] Field of Search ..... 160/168.1 V, 173 V, 160/178.1 V, 900

[56] References Cited

U.S. PATENT DOCUMENTS

| | | | |
|---|---|---|---|
| 2,790,492 | 4/1957 | Toti | 160/173 V |
| 4,140,169 | 2/1979 | Arena | 160/178.1 V |
| 4,291,738 | 9/1981 | Grenga et al. | 160/900 X |
| 4,293,021 | 10/1981 | Arena | 160/178.1 V |
| 4,688,618 | 8/1987 | Saicheck, Jr. et al. | 160/900 X |
| 4,872,499 | 10/1989 | Anderson | 160/168.1 V |
| 4,887,657 | 12/1989 | Spohr | 160/178.1 V |
| 4,936,370 | 6/1990 | Uecker et al. | 160/900 X |
| 4,993,469 | 2/1991 | Moench | 160/900 X |
| 5,022,453 | 6/1991 | Rozon | 160/168.1 V |
| 5,092,386 | 3/1992 | Spohr et al. | 160/173 V |
| 5,168,913 | 12/1992 | Haines | 160/168.1 V |
| 5,501,261 | 3/1996 | Peale | 160/900 X |
| 5,524,692 | 6/1996 | John | 160/173 V |

*Primary Examiner*—Blair Johnson
*Assistant Examiner*—Bruce A. Lev
*Attorney, Agent, or Firm*—Browdy and Neimark

[57] ABSTRACT

A distance adjusting structure for a vertical blind, including a pulley seat and a distance adjusting cord. The pulley seat is composed of a seat body, a top cover and a pressing block. A slat clip is disposed under the seat body for clipping a slat. An ohm set is disposed in the seat body. Two latch ribs are disposed on outer faces of upper ends of front and rear walls of the seat body and two hooking holes are formed on upper sections of a left and a right walls of the seat body. The top cover is disposed with two projecting blocks on middle section of top face, which define a cord groove. A post is disposed on each projecting block. A stopper block is disposed under middle section of bottom face of the top cover. A rib hook is disposed under the stopper block and protrudes therefrom. Two downward extending right angle latch hooks are formed at two ends of the top cover. The pressing block is formed with a central adhesive filling hole and two sockets on bottom face beside the filling hole. The space between the spread pulley seats is predetermined and fixed according to the width of the slat prior to the assembling procedure so as to be applicable to various specifications of slats.

1 Claim, 4 Drawing Sheets

DISTANCE ADJUSTING STRUCTURE FOR A VERTICAL BLIND

BACKGROUND OF THE INVENTION

The present invention relates to a distance adjusting structure for a vertical blind.

FIG. 1 shows a conventional distance adjusting structure for a vertical blind, including a pulley seat 10 and a distance adjusting strip 20. A slat clip 11 is disposed under the pulley seat 10 for clipping a slat 30. An ohm set 12 is disposed in the pulley seat 10. Two slots 13, 14 are formed on two sides of the pulley seat 10. The distance adjusting strip 29 has a first end formed with a slightly upward bent section 21 and a second end formed with an upward bent section 23. An upward folded projection 22 is formed on inner side of the section 21. A downward folded projection 24 and a downward bent stopper plate 25 are formed at the end of the section 23.

Please refer to FIGS. 2 and 8. When assembled, the upward bent section 21 of the distance adjusting strip 20 is sequentially inserted into the slots 13, 14 of the pulley seat 10 with the downward folded projection 24 of the section 23 engaged with inner side of the slot 13 of the pulley seat 10. The stopper plate 25 of the distance adjusting strip 20 is engaged with outer side of the slot 13 of the pulley seat 10, whereby the upward bent section 23 is secured between the slots 13, 14 of the pulley seat 10. Then the slightly upward bent section 21 of the distance adjusting strip 20 is further inserted through the slot 13 of the adjacent pulley seal 10 and overlapped on the section 23 of the adjacent distance adjusting strip 20, whereby the section 21 is restricted by the projection 22 from being withdrawn from the slot 13 of the adjacent pulley seat 10. A desired number of pulley seats 10 and distance adjusting strips 20 are assembled according to the above procedure to complete the assembly.

According to the above arrangement, a shortcoming exists as follows:

The length of the distance adjusting strip 20 is fixed so that the distance adjusting strip 20 with a specific dimension is only applicable to one specification of slat.

SUMMARY OF THE INVENTION

It is therefore a primary object of the present invention to provide a distance adjusting structure for a vertical blind, in which the space between the spread pulley seats is predetermined and fixed according to the width of the slat prior to the assembling procedure so as to be applicable to various specifications of slats.

The present invention can be best understood through the following description and accompany drawings, wherein:

DETAILED DESCRIPTION OF THE PREFERRED EMBODIMENT

Figure 3:
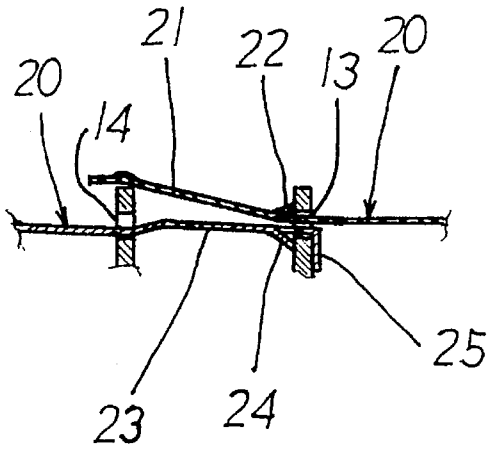
Fig. 3 Prior Art
FIG. 3 is a sectional view of a part of the conventional distance adjusting structure.
Figure 1:
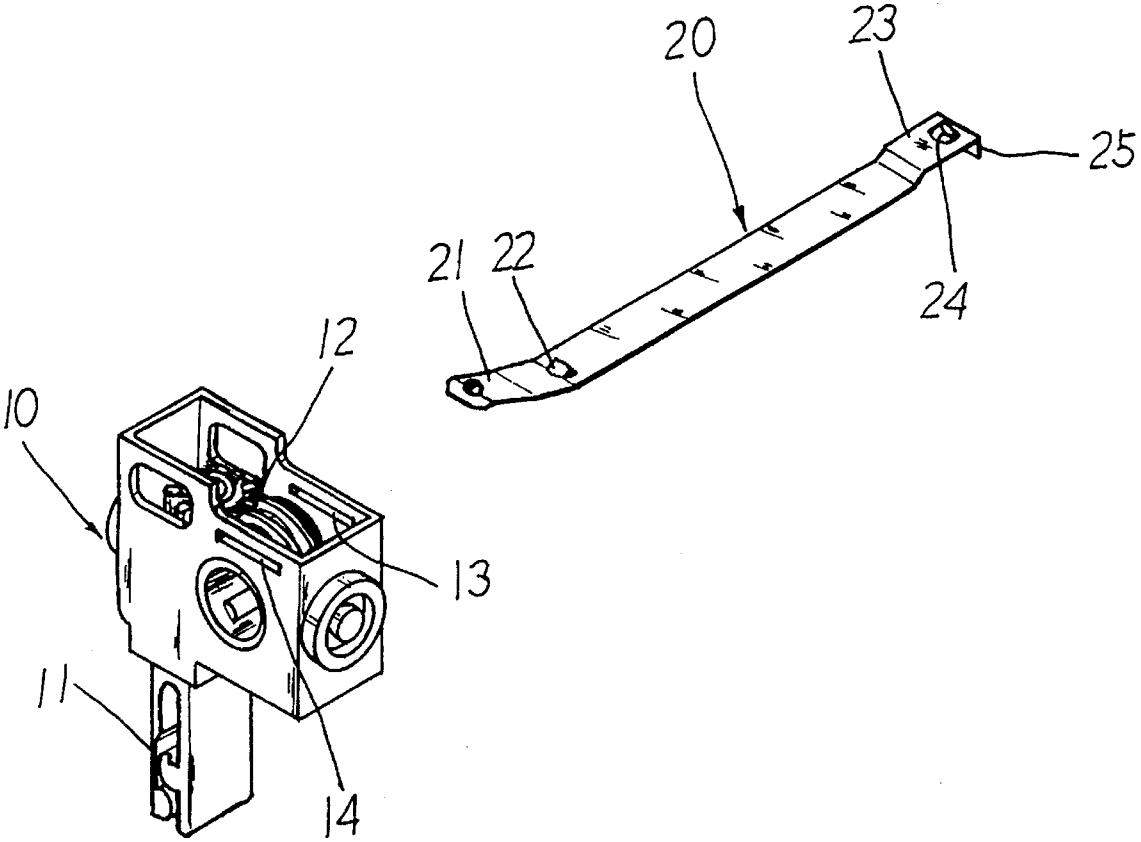
Fig. 1 Prior Art
FIG. 1 is a perspective exploded view of a conventional distance adjusting structure for a vertical blind.
Figure 2:
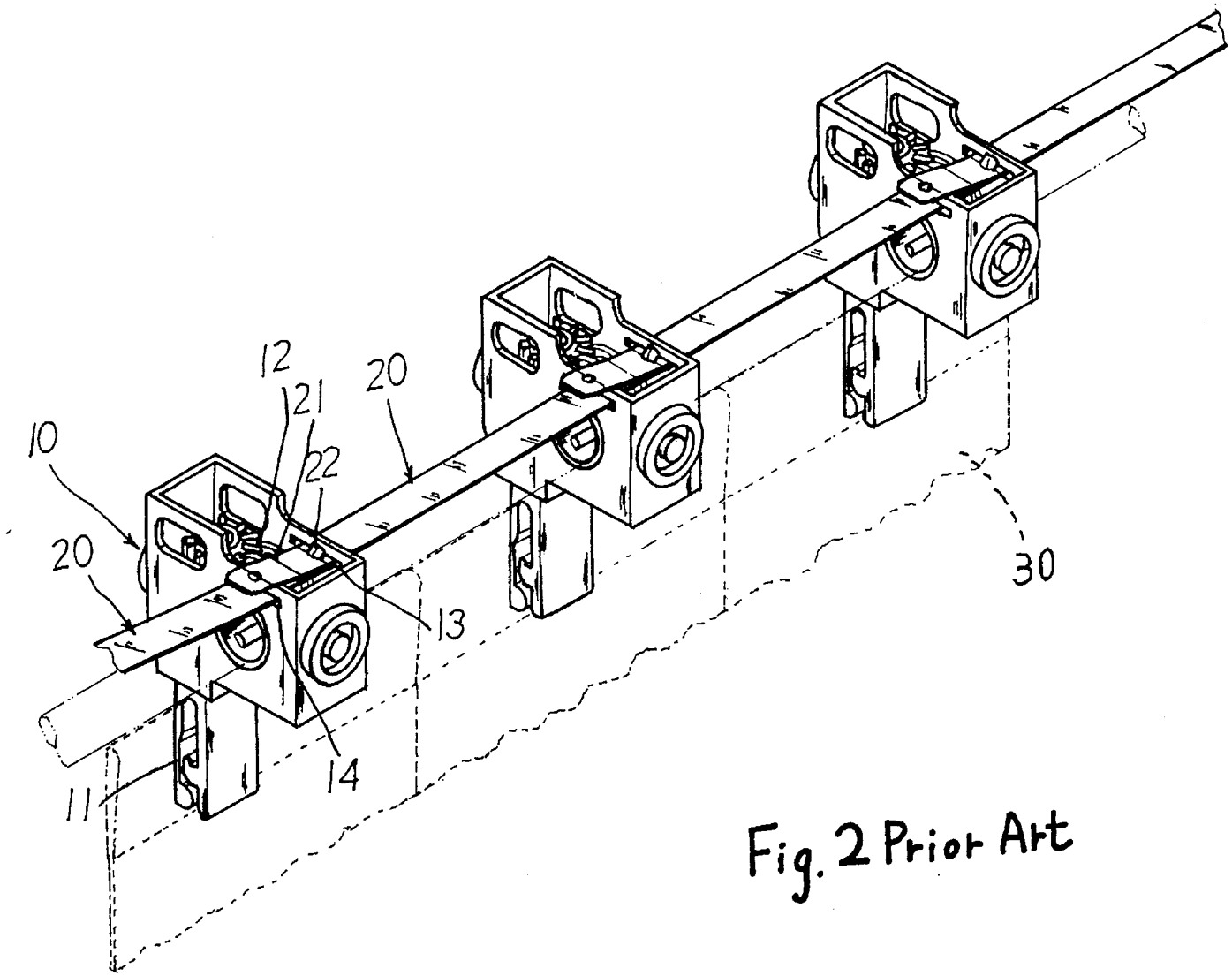
Fig. 2 Prior Art
FIG. 2 is a perspective assembled view of a series of conventional distance adjusting structures in a spread state.
Figure 4:
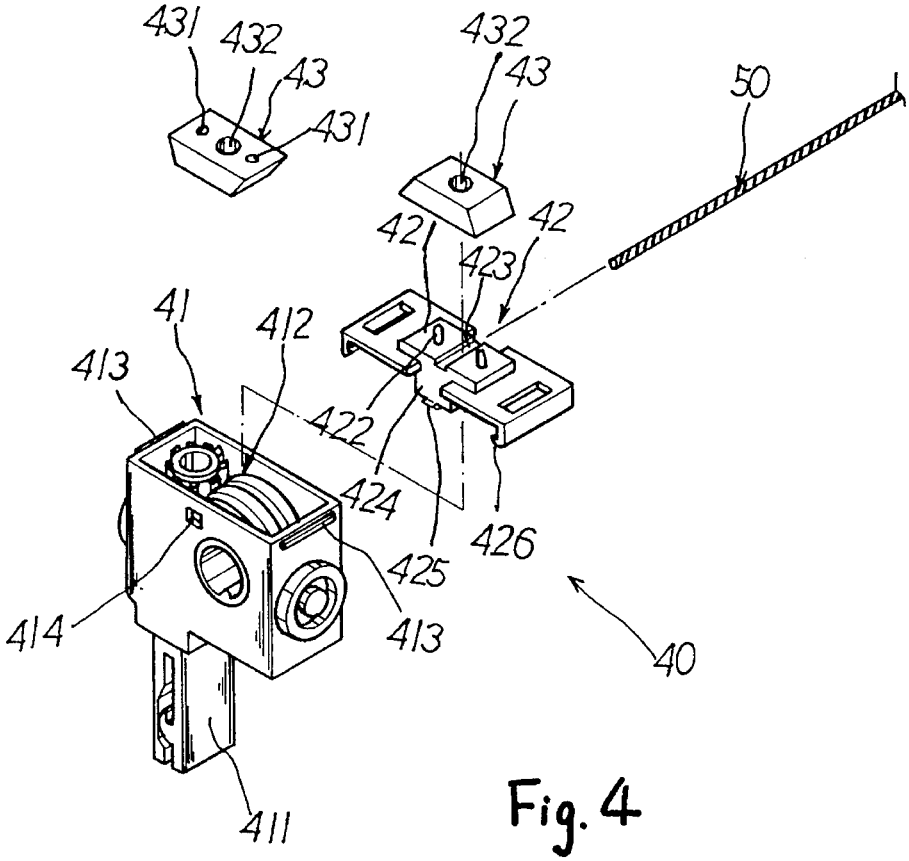
FIG. 4 is a perspective exploded view of the distance adjusting structure of the present invention.

Please refer to FIG. 4. The present invention includes a pulley seat 40 and a distance adjusting cord 50. The pulley seat 40 is composed of a seat body 41, a top cover 42 and a pressing block 43. A slat clip 411 is disposed under the seat body 41 for clipping a slat 30. An ohm set 412 is disposed in the seat body 41. Two latch ribs 413 are disposed on outer faces of upper ends of front and rear walls of the seat body 41. Two hooking holes 414 are formed on upper sections of a left and a right walls of the seat body 41. The top cover 42 is disposed with two projecting blocks 421 on middle section of top face, which define a cord groove 423. A post 422 is disposed on each projecting block 421. A stopper block 424 is disposed under middle section of bottom face of the top cover 42. A rib hook 425 is disposed under the stopper block 424 and protrudes therefrom. Two downward extending right angle latch hooks 426 are formed at two ends of the top cover 42. The pressing block 43 is formed with a central adhesive filling hole 432 and two sockets 431 on bottom face beside the filling hole 432.

Figure 5:
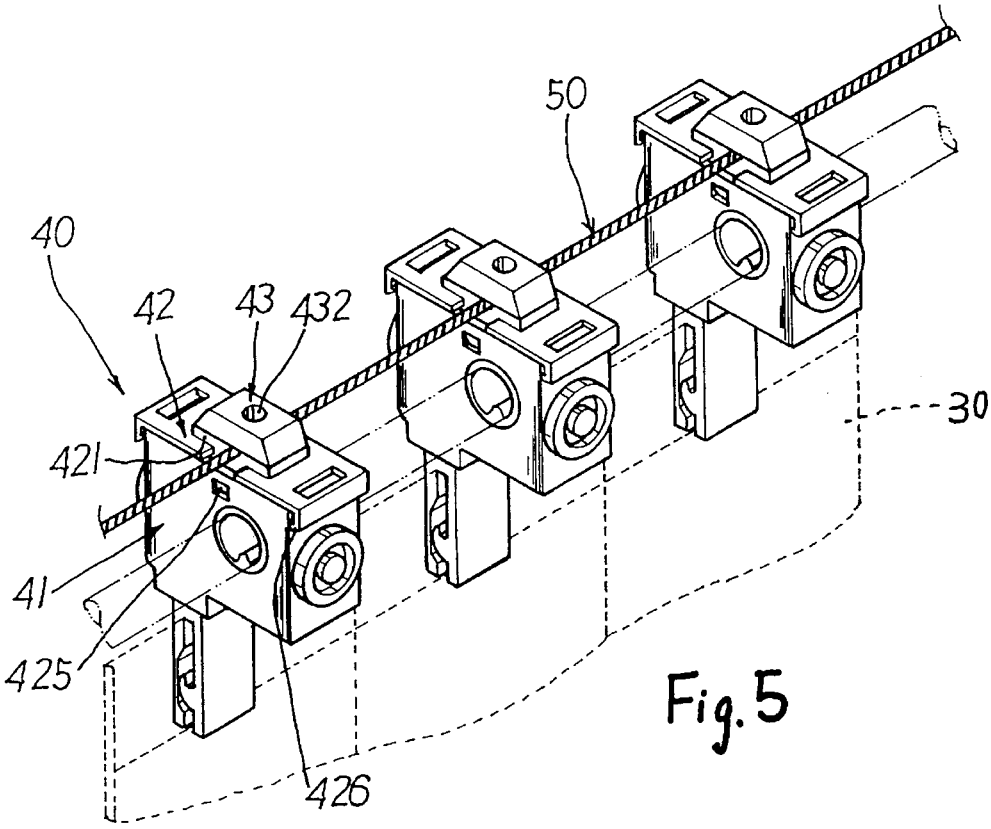
FIG. 5 is a perspective assembled view of a series of the distance adjusting structures of the present invention in a spread state.
Figure 6:
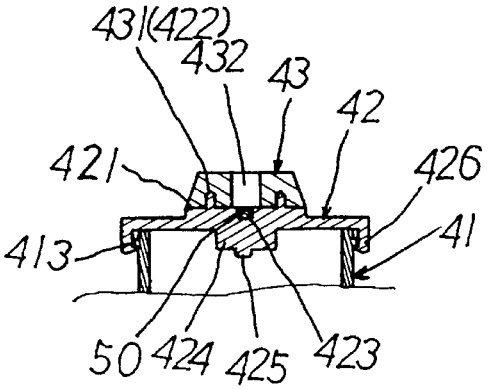
FIG. 6 is a sectional view of a part of the present invention.
Figure 7:
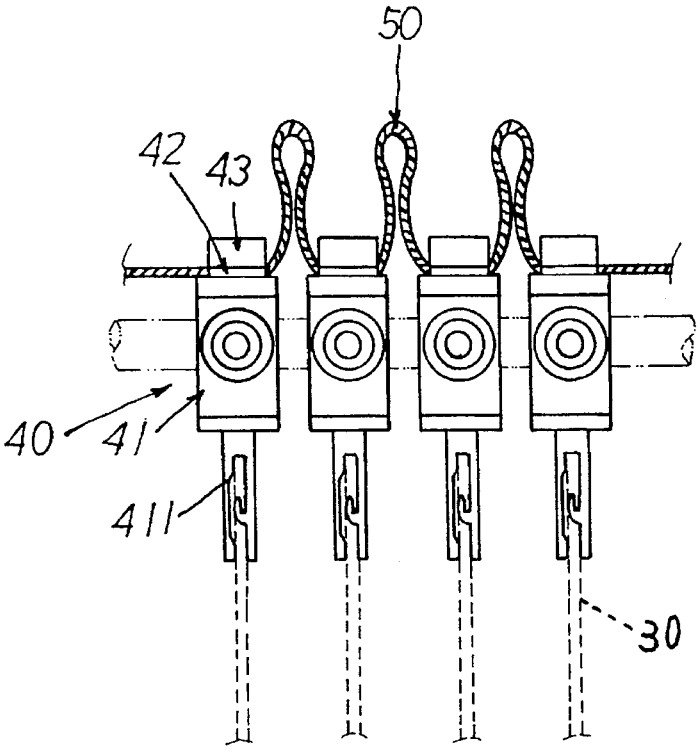
FIG. 7 is a side view of a series of the distance adjusting structures of the present invention in a close state.

Please refer to FIGS. 5 and 6. When assembled, the top cover 42 is pressed onto the seat body 41 with the latch hooks 426 of the top cover 42 latched by the latch ribs 413 of the seat body 41. Also, the rib hook 425 of the stopper block 424 of the top cover 42 is locked in the hooking holes 414 of the seat body 41. Then each top cover 42 together with the seat body 41 is positioned under the distance adjusting cord 50 by a desired distance from the other with the cord 50 placed in the cord groove 423 of the top cover 42. Then the pressing block 43 is associated with the top cover 42 with the posts 422 inserted into the sockets 431 of the pressing block 43 so that the bottom face the pressing block 43 abuts against the cord 50. Then an adhesive is filled into the filling hole 432 of the pressing block 43 so as to securely fix the cord 50. A desired number of seat bodies 41, top covers 42 and pressing blocks 43 are disposed on the distance adjust cord 50 at desired intervals to complete the assembly. Referring to FIG. 7, when the pulley seats 40 are in a close state, the distance adjusting cord 50 between each two adjacent pulley seats 40 is upward bent to form a loop pattern.

By means of the above arrangement, the space between the spread pulley seats 40 can be predetermined and fixed according to the width of the slat 30 prior to the assembling procedure. Therefore, the present invention is applicable to various specifications of slats 30.

The above embodiment, is only an example of the present invention and the scope of the present invention should not be limited to the example. Any modification or variation derived from the example should fall within the scope of the present invention.

What is claimed is:

1. A distance adjusting structure for a vertical blind, comprising a pulley seat and a distance adjusting cord, the pulley seat being composed of a seat body, a top cover and a pressing block, a slat clip being disposed under the seat body for clipping a slat, an ohm set being disposed in the seat body, said distance adjusting structure being characterized in that:

two latch ribs are disposed on outer faces of upper ends of front and rear walls of the seat body and two hooking holes are formed on upper sections of left and right walls of the seat body, the top cover being disposed with two projecting blocks on a middle section of a top face, which define a cord groove, a post being disposed on each projecting block, a stopper block being disposed under a middle section of a bottom face of the top cover, a rib hook being disposed under the stopper block and protruding therefrom, two downward extending right angle latch hooks being formed at two ends of the top cover, the pressing block being formed with a central adhesive filling hole and two sockets on a bottom face beside the filling hole, whereby when assembled, the top cover is pressed onto the seat body with the latch hooks of the top cover latched by the latch ribs of the seat body and the rib hook of the stopper block of the top cover is locked in the hooking holes of the seat body and then each top cover together with the seat body is positioned under the distance adjusting cord by a desired distance from the other with the cord placed in the cord groove of the top cover, the pressing block being associated with the top cover with the posts inserted into the sockets of the pressing block so that the bottom face of the pressing block abuts against the cord, an adhesive being filled into the filling hole of the pressing block so as to securely fix the cord, a desired number of seat bodies, top covers and pressing blocks being disposed on the distance adjusting cord at desired intervals, spacing between spread pulley seats being predetermined and fixed according to the width of the slat prior to assembly so as to be applicable to various specifications of slats.

* * * * *